US008500043B2

(12) United States Patent
Heigl

(10) Patent No.: US 8,500,043 B2
(45) Date of Patent: Aug. 6, 2013

(54) DEVICE FOR SPRAYING ON PIGMENTED LIQUIDS

(75) Inventor: Berthold Heigl, Königsmoos (DE)

(73) Assignee: Bernd Kriesmair, München (DE)

( * ) Notice: Subject to any disclaimer, the term of this patent is extended or adjusted under 35 U.S.C. 154(b) by 1176 days.

(21) Appl. No.: 12/063,652

(22) PCT Filed: Aug. 9, 2006

(86) PCT No.: PCT/EP2006/007880
§ 371 (c)(1),
(2), (4) Date: Feb. 12, 2008

(87) PCT Pub. No.: WO2007/019997
PCT Pub. Date: Feb. 22, 2007

(65) Prior Publication Data

US 2010/0282868 A1 Nov. 11, 2010

(30) Foreign Application Priority Data

Aug. 12, 2005 (DE) ..... 10 2005 038 162

(51) Int. Cl.
*B05B 7/12* (2006.01)

(52) U.S. Cl.
USPC ..... 239/407; 239/600

(58) Field of Classification Search
USPC ..... 239/407, 290, 291, 569, 582.1, 600
See application file for complete search history.

(56) References Cited

U.S. PATENT DOCUMENTS

| | | | | |
|---|---|---|---|---|
| 595,931 | A | 12/1897 | Wold | |
| 649,431 | A | 5/1900 | Burdick | |
| 2,959,358 | A * | 11/1960 | Vork | 239/330 |
| 4,102,500 | A | 7/1978 | Luff | |
| 4,685,622 | A | 8/1987 | Shimohira et al. | |

(Continued)

FOREIGN PATENT DOCUMENTS

| | | | |
|---|---|---|---|
| CA | 2618816 | A1 | 2/2007 |
| DE | 26 55 224 | A1 | 6/1977 |

(Continued)

OTHER PUBLICATIONS

Search Report issued in German Application No. 10 2005 038 162.6.

(Continued)

*Primary Examiner* — Davis Hwu
(74) *Attorney, Agent, or Firm* — Browdy and Neimark, PLLC

(57) ABSTRACT

In a device for spraying on pigmented liquids by means of an air flow comprising a base body, a spray nozzle disposed at the front side of the base body, said spray nozzle having a needle acted upon by a spring disposed in the center thereof, a compressed air inlet and an adjacent compressed air duct, an inlet for a pigmented liquid, with a controllable compressed air flow supplied via the compressed air duct being guided past an inlet for the pigmented liquid where it is loaded with droplets of liquid, said droplets of liquid being discharged by the spray nozzle as long as the compressed air flow is maintained, it is provided that the nozzle (5) and the needle (12) are positioned in a nozzle carrier (10), with the nozzle carrier (10) being provided with the inlet (17) for the pigmented liquid, and with the nozzle carrier being removable or replaceable, respectively, as a whole.

6 Claims, 1 Drawing Sheet

(56) References Cited

U.S. PATENT DOCUMENTS

| | | | | |
|---|---|---|---|---|
| 5,156,684 | A | 10/1992 | Mayer et al. | |
| 5,366,158 | A | 11/1994 | Robisch et al. | |
| 5,454,517 | A | 10/1995 | Naemura | |
| 6,098,902 | A * | 8/2000 | Culbertson et al. | 239/290 |
| 6,105,881 | A | 8/2000 | Kitajima | |
| 7,090,149 | B2 | 8/2006 | Fedorov | |
| 7,389,948 | B1 | 6/2008 | Lampman | |
| 2002/0166902 | A1 * | 11/2002 | Pettit et al. | 239/296 |
| 2004/0065755 | A1 | 4/2004 | Turnbull | |

FOREIGN PATENT DOCUMENTS

| | | | |
|---|---|---|---|
| DE | 195 25 611 | A1 | 1/1997 |
| DE | 19525611 | A1 | 1/1997 |
| DE | 26 55 224 | A1 | 1/2007 |
| DE | 10 2005 038162 | A1 | 2/2007 |
| EP | 04 82 569 | A1 | 4/1992 |
| EP | 1 340 550 | A2 | 9/2003 |
| EP | 195 25 611 | A1 | 9/2003 |
| EP | 1340550 | A2 | 9/2003 |
| GB | 102910 | A | 1/1917 |
| WO | 92/19386 | A1 | 11/1992 |
| WO | 95/13881 | | 5/1995 |
| WO | 01/66261 | A2 | 9/2001 |
| WO | 2004/098785 | A1 | 11/2004 |
| WO | 95/13881 | | 5/2005 |
| WO | 2007/019997 | A1 | 2/2007 |
| WO | 2008/125209 | A1 | 10/2008 |

OTHER PUBLICATIONS

International Preliminary Report on Patentability issued in International Appl No. PCT/EP06/07880.

Written Opinion issued in International Appl No. PCT/EP06/07880.

International Search Report issued in International Appl No. PCT/EP06/07880.

* cited by examiner

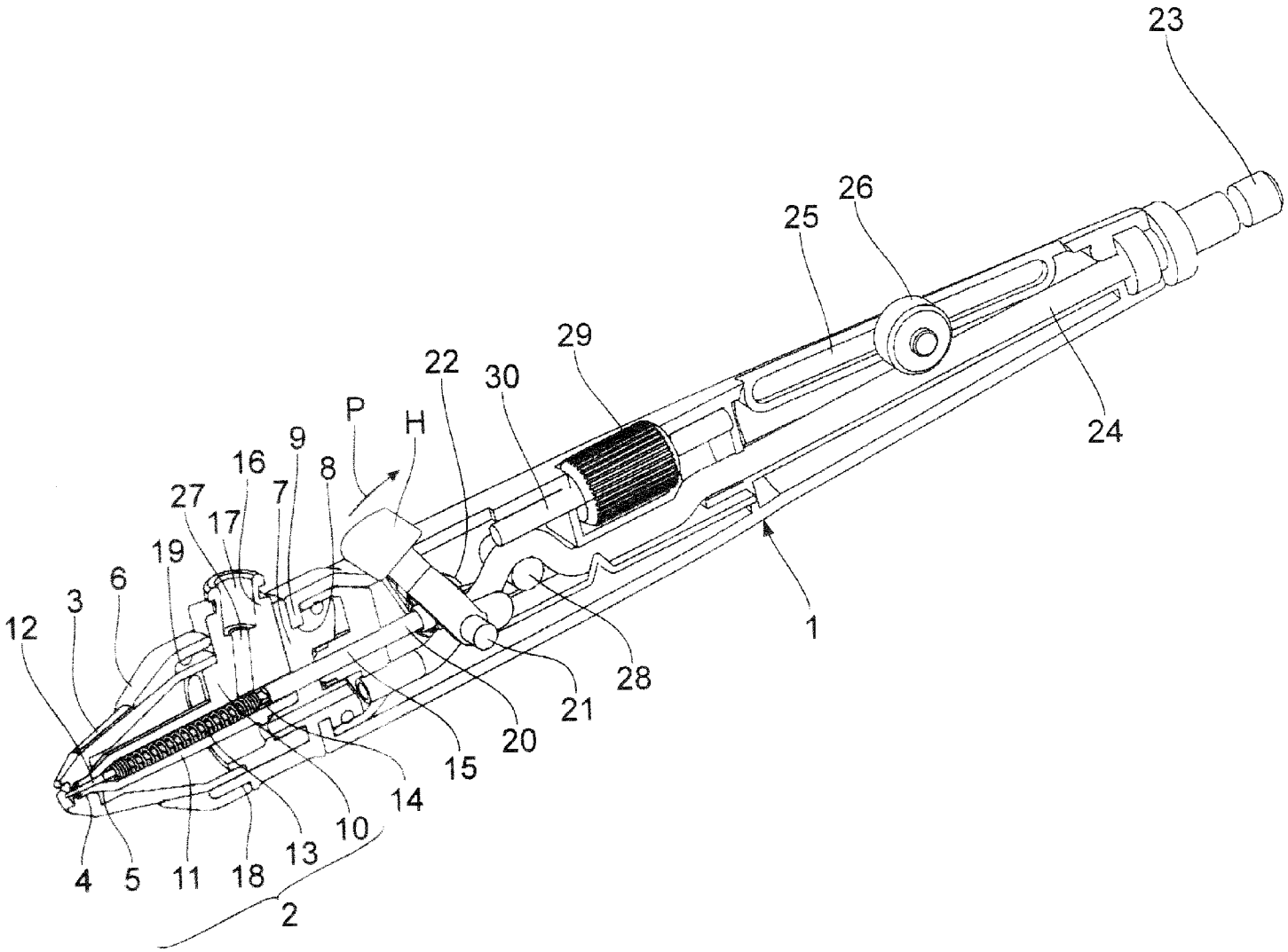
23
24
26
25
1
29
30
22
H
P
28
21
20
15
14
10
13
2
18
11
5
4
8
9
7
16
17
27
19
6
3
12

DEVICE FOR SPRAYING ON PIGMENTED LIQUIDS

FIELD OF INVENTION

The invention relates to a device for spraying on pigmented liquids by means of an air flow comprising a base body, a spray nozzle disposed at the front side of the base body, a compressed air inlet and an adjacent compressed air duct, an inlet for a pigmented liquid, with a. controllable compressed air flow supplied via the compressed air duct being guided past an inlet for the pigmented liquid where it is loaded with droplets of liquid, said droplets of liquid being discharged by the spray nozzle as long as the compressed air flow is maintained.

BACKGROUND

Such devices are conventionally referred to as air brush or "spray gun". The entrainment of the droplets of liquid is due to a low pressure generated by a Venturi effect. In principle, such a device may be used for the application of completely different types of media. To simplify matters, the following description only refers to the use of colour.

A device of the generic type is known from U.S. Pat. No. 5,454,517. A drawback of such devices is that changing the colour or cleaning the nozzle after a longer downtime period, which requires a substantial amount of time and effort whilst also involving the risk of damage to the delicate needle disposed in the nozzle, may lead to severe malfunctions or to functional failure.

SUMMARY OF THE INVENTION

Based thereon, it is the object of the invention to design such a device in a way as to be produced in a very cost-effective manner whilst being advantageous to use, thereby eliminating in particular a cleaning of the nozzle along with the problems arising therefrom.

This object may be attained by the nozzle and the needle being positioned in a colour-carrying nozzle part, with the colour-carrying nozzle part having the inlet for the pigmented liquid, and with the colour-carrying nozzle part being removable or replaceable, respectively, as a whole.

This design has the considerable advantage that all parts impinged by colour may be removed or replaced, respectively, together, thus allowing for a completely problem-free change of colour without requiring any manual cleaning whatsoever. When a new spray head is attached, no contamination by another colour is given, thus ensuring that the new colour may be sprayed without being affected in any way.

Advantageously, an air duct in the shape of a flexible hose is provided the diameter of which is favourably variable so as to adjust the throughput of air.

This may favourably be achieved by a wheel disposed in a guide extending at an angle with respect to the hose, with the wheel opening the free cross-section of the hose to a higher or lower extent, depending on the axial position of the wheel which is operable from the outside of the housing.

The actuating lever is assigned an adjustable stop for the actuating lever so as to obtain a constantly even spray pattern.

This adjustable stop is preferably formed by a threaded rod which is axially displaceable by means of an externally accessible knurled nut.

According to an advantageous embodiment, it is furthermore provided that a nozzle cover surrounding the colour duct is integrally bonded with the nozzle and may be fixed by means of a safety screw.

BRIEF DESCRIPTION OF THE DRAWING

The following is a more detailed description of the invention by means of a preferred embodiment, taken in conjunction with the drawing, wherein said drawing (sole figure) shows a longitudinal section through a device according to the invention.

DETAILED DESCRIPTION OF EMBODIMENTS

A device according to the invention has a longitudinal base body 1 which may be hand-held in a pencil-like manner, with a colour-carrying nozzle part 2 being disposed at the front end thereof.

The colour-carrying nozzle part 2 comprises a conical nozzle cover 3 with a through and guide bore 4 for a nozzle 5, a safety cover 6 overlapping with the nozzle cover 3 and a ring body 7.

The ring body 7 has an annular, circumferential groove 8, with a guide collar 9 of the base body 1 engaging therewith so that the ring body is mounted for rotation through 360°.

Moreover, a nozzle support 10 is disposed in the colour-carrying nozzle part 2, with a nozzle pipe 11 on the front end of which the nozzle 5 is formed extending away therefrom. A needle 12, which is acted upon by a helical spring 13, is positioned inside the nozzle pipe 11. The helical spring 13 and the needle 12 are positioned in a longitudinal bore 14 of the nozzle support 10, with a longitudinally displaceable ram 15 acting into said longitudinal bore 14, as described below.

The nozzle support 10 has a substantially circular outer shape and may be form-fitted into the ring body 7, with a lateral projection 16 of the nozzle support 10 engaging with a slot—not shown in the drawing—of the ring body 7 in a way as to be fixed with respect to the ring body 7 in a non-rotational manner, with the latter, however, in turn being rotatable with respect to the base body 1.

A colour inlet 17 in the shape of a recess is formed in the projection 16, with either a connecting hose leading to a colour reservoir or the connecting plug of a small, directly attachable colour reservoir being insertable into said colour inlet 17.

The ring body 7 has an external thread 18 over which the internal thread 19 of the safety cover 6 may be screwed. This way, the nozzle cover 3 may be attached to the ring body 7 via the safety cover 6 whilst at the same time axially fixing the nozzle support 10 which is positioned in the front-side recess of the base body 1.

It is apparent from the above description that the entire colour-carrying nozzle part 2 is rotatable with respect to the base body 1, and that the nozzle support 10, together with the colour inlet 17, the nozzle 5, the nozzle needle 12 and the helical spring 13, is replaceable in a way that no colour-carrying parts are left behind so that work may continue with another colour, i.e. upon inserting a new nozzle support 10, without any problems whatsoever.

The rear end of the nozzle needle 12 is attached to the helical spring 13, while the front end of said helical spring rests against the tapered nozzle 5 in a way that a forward movement of the actuating ram 15 causes the helical spring 13 to be compressed, while a backward movement of the actuating ram 15 causes the helical spring 13 to retract the nozzle needle 12.

At its inner end 20, the actuating ram 15 is attached to an actuating lever H operable in the direction of the arrow P and mounted for rotation about an axis of rotation, said actuating lever H causing the actuating ram 15 to be moved to the right or backwards, respectively, when displaced in the direction of the arrow P against the force of a return spring 22, which enables the helical spring 13 to displace the needle 12 in the drawing to the right, and consequently, to steadily increase the size of the through-opening of the nozzle when moving further to the right, thereby allowing a correspondingly larger amount of colour to be delivered.

An air inlet 23 is provided at the rear end of the base body 1. An air duct 24 of a hose-like, flexible material adjoins said air inlet 23 towards the inside. A guide 25 for an adjusting wheel 26 having a knurled surface extends at an angle with respect to the air duct 24, said adjusting wheel 26 engaging with the compressed air duct 24, thus opening the latter when displaced forward and closing the same when displaced backwards, thereby allowing to adjust the throughput of compressed air.

The compressed air duct 24 projects into the conically tapered nozzle cover 3, causing the air flow to be accelerated and to flow past the nozzle 5, thereby entraining the colour from a colour duct 27 adjoining the colour inlet 17 due to the low pressure generated by the Venturi effect so that a colour-air mixture is discharged through the nozzle 5.

The compressed air may for example be generated by means of a compressor. The maximum operating pressure amounts to 3 bar.

The air duct 24 is guided past the lever H and is squeezed closed when the lever H is situated in the forward locking position. When the lever H is displaced in the direction of the arrow P, this causes the nozzle 5 to be opened due to the backward displacement of the needle, thereby simultaneously opening the compressed air duct 24, as already described.

The travel of the actuating lever H may be limited or adjusted, respectively, by means of a knurled nut 29, thus enabling a constant thickness of the sprayed line to be maintained over a longer period of time. The knurled nut 29 is positioned on a threaded rod 30 which is axially displaced by a rotary movement of the knurled nut 29, thereby forming a displaceable stop for the actuating lever 17.

The invention claimed is:

1. A device for spraying on pigmented liquids by means of an air flow comprising a base body, a spray nozzle disposed at the front side of the base body, with a needle disposed centrally in said spray nozzle and acted upon by a spring, a compressed air inlet and an adjacent compressed air duct, an inlet for a pigmented liquid, with a controllable compressed air flow supplied via the compressed air duct being guided past an inlet for the pigmented liquid where it is loaded with droplets of liquid, said droplets of liquid being discharged by the spray nozzle as long as the compressed air flow is maintained, wherein the nozzle (5) and the needle (12) are positioned in a nozzle support (10), with the nozzle support (10) being provided with the inlet (17) for the pigmented liquid and with the nozzle support (10) together with the inlet (17) for the pigmented liquid, the nozzle (5), the needle (12) and the helical spring (13) being removable or replaceable, respectively, as a whole, whereby all parts impinged by color are removable or replaceable together, and wherein a nozzle cover (3) is attachable on a ring body (7), which is mounted to a base body (1) for rotation through 360°, and fixable by a safety cover (36) which is screwable thereon, thus axially fixing the nozzle support (10), the nozzle support (10) including the inlet (17) for the pigmented liquid together with the ring body (7) being rotatable with respect to the base body (1).

2. A device according to claim 1 wherein an air duct in the shape of a flexible hose (25) is provided.

3. A device according to claim 2 wherein the diameter of the hose (25) is variable.

4. A device according to claim 1 wherein a displaceable stop (threaded rod (30) is provided for an actuating lever (H).

5. A device according to claim 1 wherein the displaceable stop is formed by a threaded rod (24) which is axially displaceable by means of an externally accessible knurled nut (29).

6. A device for spraying on pigmented liquids by means of an air flow comprising:

a base body, a spray nozzle disposed at the front side of the base body, with a needle disposed centrally in said spray nozzle and acted upon by a spring, a compressed air inlet and an adjacent compressed air duct, an inlet for a pigmented liquid, with a controllable compressed air flow supplied via the compressed air duct being guided past an inlet for the pigmented liquid where it is loaded with droplets of liquid, said droplets of liquid being discharged by the spray nozzle as long as the compressed air flow is maintained, wherein the nozzle (5) and the needle (12) are positioned in a nozzle support (10), with the nozzle support (10) being provided with the inlet (17) for the pigmented liquid and with the nozzle support (10) being removable or replaceable, respectively, as a whole, wherein a nozzle cover (3) is attachable on a ring body (7), which is mounted to a base body (1) for rotation through 360° , and fixable by a safety cover (36) which is screwable thereon, thus axially fixing the nozzle support (10), wherein an air duct in the shape of a flexible hose (25) is provided, wherein the diameter of the hose (25) is variable, and wherein a wheel (26) is disposed in a guide (25) which extends at an angle with respect to the hose (24), with the wheel (26), which is operable from the outside of the housing, opening the free cross-section of the hose (24) to a higher or lower extent, depending on the axial position of the wheel (26).

* * * * *